US006819893B2

(12) United States Patent
Kikuchi

(10) Patent No.: US 6,819,893 B2
(45) Date of Patent: Nov. 16, 2004

(54) IMAGE FORMING APPARATUS AND CHARGING DEVICE

(75) Inventor: Nobuo Kikuchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/420,880

(22) Filed: Apr. 23, 2003

(65) Prior Publication Data

US 2003/0231896 A1 Dec. 18, 2003

(30) Foreign Application Priority Data

Apr. 24, 2002 (JP) ..... 2002-122306

(51) Int. Cl.[7] ..... G03G 15/02

(52) U.S. Cl. ..... 399/100; 250/325; 399/170; 430/110.4

(58) Field of Search ..... 399/170, 168, 399/171, 172, 173, 100; 250/324, 325, 326; 430/110.4, 110.1, 120, 902

(56) References Cited

U.S. PATENT DOCUMENTS

| | | | | | |
|---|---|---|---|---|---|
| 2,297,691 | A | | 10/1942 | Carlson | 430/55 |
| 4,019,055 | A | * | 4/1977 | Derleth | 399/100 |
| 5,483,327 | A | * | 1/1996 | Taya et al. | 399/223 |
| 5,485,255 | A | * | 1/1996 | Reuschle et al. | 399/168 |
| 5,512,708 | A | | 4/1996 | Takahashi et al. | 399/252 |
| 5,557,373 | A | | 9/1996 | Miyashita et al. | 399/9 |
| 5,568,230 | A | * | 10/1996 | Reddy et al. | 399/100 |
| 5,572,293 | A | | 11/1996 | Kikuchi et al. | 399/357 |
| 5,585,896 | A | | 12/1996 | Yamazaki et al. | 399/174 |
| 5,666,599 | A | * | 9/1997 | Miyasaka et al. | 399/162 |
| 5,731,122 | A | * | 3/1998 | Yoshida et al. | 430/126 |
| 5,909,609 | A | | 6/1999 | Yahata et al. | 399/258 |
| 6,064,845 | A | * | 5/2000 | Suzuki | 399/170 |
| 2002/0006567 | A1 | * | 1/2002 | Matsuda et al. | 430/110.4 X |
| 2003/0002894 | A1 | * | 1/2003 | Satoh | 399/324 |
| 2003/0077094 | A1 | * | 4/2003 | Seki | 399/330 |

FOREIGN PATENT DOCUMENTS

| | | | |
|---|---|---|---|
| JP | 43-024748 | | 10/1968 |
| JP | 49-023910 | | 6/1974 |
| JP | 59-204058 | * | 11/1984 |
| JP | 63-149668 | | 6/1988 |
| JP | 01-112253 | | 4/1989 |
| JP | 02-284158 | | 11/1990 |
| JP | 02-301777 | | 12/1990 |
| JP | 05-045724 | | 2/1993 |
| JP | 07-140762 | | 6/1995 |
| JP | 07-140868 | | 6/1995 |
| JP | 07-175299 | | 7/1995 |
| JP | 07-295283 | | 11/1995 |
| JP | 08-305135 | | 11/1996 |
| JP | 09-068846 | * | 3/1997 |
| JP | 2002-123064 | * | 4/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus uses a developer that includes toner with volume average particle size between 5 μm and 10 μm and 60 to 80 number percentage particles having a particle size less than or equal to 5 μm. A charging unit charges a latent image carrier. The charging unit and the latent image carrier are arranged in such a manner that they do no make a physical contact.

23 Claims, 4 Drawing Sheets

IMAGE FORMING APPARATUS AND CHARGING DEVICE

BACKGROUND OF THE INVENTION

1) Field of the Invention

The present invention relates to a charging unit that is used in a charging process, which is one of the processes for forming an image.

2) Description of the Related Art

Electrophotography has been published as one of the processes for forming an image according to the information of an image or a document, in U.S. Pat. No. 2297691, Japanese Patent Publications (Koukoku) 49-23910 and 43-24748.

In electrophotography, generally, an electrostatic latent image is formed by a photo irradiation process according to the information of an image or a document, by exposure or writing on a photoconductive matter of a photoreceptor, which is a latent image carrier. In case of dry developing, the corresponding latent image is developed by using a dry toner, thereby heating, pressurizing in order to fix the processed visual image for copying.

Developing methods are mainly divided into liquid developing and dry developing. The liquid developing method includes cascading that uses a liquid developer composed of an insulating organic liquid, in which pigments, dyes of various types are dispersed minutely. The dry developing method includes magnetic brushing or powder clouding that use toner formed by dispersing colorants like carbon black etc. in a natural or synthetic resin. There are two types of developers—a one-component developer and a two-component developer. The one-component developer contains only toner. The two-component developer contains toner and carrier.

In recent years, there is a tendency towards reducing the particle size of the toner to meet the demand to cope with high image quality. Especially when the latent image is dotted due to digital processing, toner having a small particle size is used, putting an emphasis on acquiring reproducibility and sharpness of dotting.

Japanese Patent Application Laid Open Publication Nos. 1-112253, 2-284158, and 7-295283 propose using the toner having small particle size to achieve a highly defined image having high resolution. These patent publications specify distribution and amount of toner having a small average particle size of less than or equal to 5 $\mu$m (micrometer).

The particle size of less than or equal to 5 $\mu$m is an essential condition for achieving a highly defined image with high resolution. The toner of this particle size, when supplied for developing of a latent image, proves to be very good in the sense that there is no blurring or distortion of an image and the toner doesn't go out from the latent image, thus enabling to form an image having superior reproducibility.

Edge effect, which is one of the problems while forming an image, is remarkable when toner of a particle size less than or equal to 5 $\mu$m is used. The edge effect can be eliminated by regulating number percentage content of toner particles having a diameter greater than or equal to 5 $\mu$m. Concretely, when the average particle size of a particle is less than or equal to 5 $\mu$m and number percentage content is between 60% and 80%, a highly defined image with high resolution is achieved. However, when the toner has such a composition, following new problem arises.

It creates a difficulty in setting sufficient charging characteristics required in charging process. The charging process is a process that is carried out after removing toner remained on surface of the photoreceptor after completion of transfer process.

The cleaning, that is the removal of the toner remained on a surface of the photoreceptor, is carried out by wiping the toner off after completion of the transfer process. When the particle size of the toner is too small, the toner is not removed completely by wiping due to improper contact between a surface of the photoreceptor and a blade to be used for wiping. The toner that goes on accumulating on the surface of the photoreceptor easily stains the charging unit, thereby hindering the regular charging of the photoreceptor.

Conventionally, a contact charging method that carries out aerial discharge by micro gap or charge injection by providing a charging member, which is in direct contact or adjacent to the photoreceptor, has been used as one of the charging methods. However, charging is carried out with the charging member almost in direct contact with the photoreceptor, in both charge injection and aerial discharge. Such charging methods are disclosed, for example, in Japanese Patent Application Laid Open Publication No. 63-149668 (Structure with a charging roller), and No. 5-45724 (Structure using a charging brush). Thus, as the toner remained on the surface of the photoreceptor increases, it enters into the area of contact between the charging unit and the photoreceptor, and affects contact of the charging unit with the photoreceptor. This results in a variation in a range of charge injection or uneven discharge, thereby causing a difficulty in maintaining the prescribed charging characteristics.

So far, in order to solve the problems, Japanese Patent Application Laid Open Publication Nos. 7-140762, 7-140868, and 2-301777 have proposed a structure that carries out cleaning of a charging roller provided on the charging unit.

However, according to the structure disclosed in the publications, the cleaning unit that carries out a different function has to be provided on the charging unit, which is meant to carry out the function of charging only. This complicates the structure and also raises the cost.

On the other hand, a decharging process is sometimes carried out along with the wiping of toner in the cleaning process; in order to remove charge remained on a surface of the photoreceptor. If the toner on the photoreceptor can not be removed completely in the cleaning process, the adhesion of the toner to the photoreceptor is weakened due to decharging, and therefore this toner remained, gets scattered from the photoreceptor to the surrounding area due to centrifugal force or air flow inside during the movement of the photoreceptor. This scattered toner or dust may enter into the charging unit, and stick to a charging member thereof.

In some cases, a wire is used as a charging member. This wire is made by drawing a material. If any minute irregularities (micro cracks or scratches caused during processing) in units of microns occurred on the surface of the charging member during the manufacturing process, the toner or dust can easily get into these minute cracks or scratches and stick there. This tendency is significant if a tungsten wire is used as a charging wire. Thus, charging unevenness mentioned above, is attributed to the sticking of toner or dust to the material which is used as a charging member.

When a wire, especially a tungsten wire is used for the charging member, it is possible to lower the discharge voltage by reducing the diameter of the wire. Even if the charge voltage increases in accordance with the increase in particles sticking to the wire during the elapsed time due to a low discharge voltage in the initial recess, partial or sudden arc discharge (leak) is hard to occur, which is an advantage. However, the problem still remains in the strength when the diameter of the wire is reduced. To solve this problem, the charging wire is thickened. However, the discharge voltage is increased, which causes the partial discharge (leak) or the sudden discharge (leak) to easily occur.

A structure for removing the toner or dust forcibly has also been proposed, for example, in Japanese Patent Application Laid Open Publication No. 7-175299 and No. 8-305135, taking into consideration the fact that the sticking of toner or dust resulted due to measurement settings or surface condition during manufacturing process of a wire can not be denied when the wire is used as a charging member. According to these publications, the toner or dust stuck to a surface of the charging wire, is removed by a cleaning device that scrapes the surface of the charging wire. However, there is a possibility of making minute scratches while scraping the surface of the charging wire during cleaning with this structure. Particularly, the volume average particle size between 5 $\mu$m and 10 $\mu$m is a characteristic of a toner to be used for achieving highly defined image with high resolution. If the toner having 60 to 80 number percentage of the particles having the particle size less than or equal to 5 $\mu$m is used, the toner enters into minute scratches that are generated during cleaning. This acts as a core on which scattered toner or floating toner can stick easily to the wire, which may give rise to charging unevenness or arc discharge during the elapsed time.

SUMMARY OF THE INVENTION

It is an object of the present invention to solve at least the problems in the conventional technology.

The image forming apparatus according to this invention, performs visible image processing on an electrostatic latent image that is formed on an electrostatic latent image carrier, by using a developer that includes a toner with a volume average particle size between 5 $\mu$m and 10 $\mu$m and 60 to 80 number percentage particles having a particle size less than or equal to 5 $\mu$m. This image forming apparatus includes a charging unit that charges the electrostatic latent image carrier. The charging unit and the electrostatic latent image carrier are not in contact with each other.

The charging device according to another aspect of the present invention uniformly charges an electrostatic latent image carrier to thereby perform visible image processing, on an electrostatic latent image formed on the electrostatic latent image carrier, by using a developer that includes a toner with a volume average particle size between 5 $\mu$m and 10 $\mu$m and 60 to 80 number percentage particles having a particle size less than or equal to 5 $\mu$m. The charging device and the electrostatic latent image carrier are not in contact with each other.

The other objects, features and advantages of the present invention are specifically set forth in or will become apparent from the following detailed descriptions of the invention when read in conjunction with the accompanying drawings.

DETAILED DESCRIPTIONS

Exemplary embodiment of the present invention will be explained below with reference to the accompanying drawings.

Figure 1:
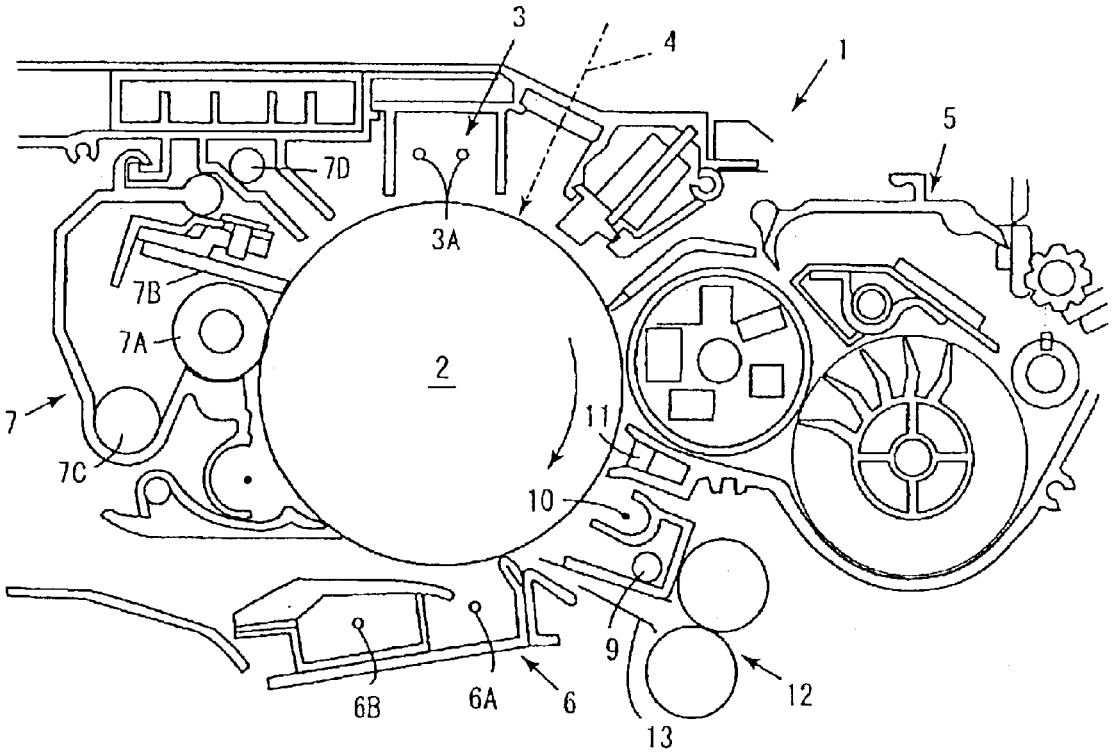
FIG. 1 is a schematic diagram of an example of an image forming apparatus according to an embodiment of the present invention.

FIG. 1 is a schematic diagram of key components of an image forming apparatus according to an embodiment of the present invention.

FIG. 1 schematically illustrates a positional relation among the components of the image forming apparatus. Although the image forming apparatus represented in this figure is a copying machine, it is not limited to the copying machine in the present invention, and can also be a printer, a facsimile, or a printing machine.

In FIG. 1, a photoreceptor 2 in the form of a drum (hereinafter, "photoreceptor drum") is provided as a latent image carrier in the copying machine.

A charging unit 3, a writing unit 4, a developing unit 5, a transfer unit 6, and a cleaning unit 7 are disposed in the area around the photoreceptor drum 2 in order to carry out image formation during rotating of the photoreceptor drum 2.

As a developer used in the developing unit 5 in this embodiment, a toner with a volume average particle size between 5 $\mu$m and 10 $\mu$m and 60 to 80 number percentage particles having a particle size equal to or less than 5 $\mu$m, is selected from the particle size distribution shown in table 1.

TABLE 1

| CH | Particle size distribution | Weight % | Number % |
|---|---|---|---|
| 1 | 1.26~1.59 | 0.00 | 0.00 |
| 2 | 1.59~2.00 | 0.00 | 0.00 |
| 3 | 2.00~2.52 | 0.51 | 6.29 |
| 4 | 2.52~3.17 | 2.03 | 12.63 |
| 5 | 3.17~4.00 | 6.02 | 19.26 |
| 6 | 4.00~5.04 | 14.84 | 24.04 |
| 7 | 5.04~6.35 | 26.47 | 21.62 |
| 8 | 6.35~8.00 | 28.37 | 12.10 |
| 9 | 8.00~10.1 | 15.52 | 3.48 |
| 10 | 10.1~12.7 | 4.64 | 0.53 |
| 11 | 12.7~16.0 | 0.86 | 0.05 |
| 12 | 16.0~20.2 | 0.27 | 0.01 |
| 13 | 20.2~25.4 | 0.00 | 0.00 |
| 14 | 25.4~32.0 | 0.00 | 0.00 |
| 15 | 32.0~40.3 | 0.00 | 0.00 |
| 16 | 40.3~50.8 | 0.00 | 0.00 |

Table 1 shows relationship of weight percentage and number percentage when the distribution rate of the volume average particle size is set.

A highly defined image with high resolution can be achieved as in table 2 by setting the volume average particle size and content rate.

TABLE 2

| | Volume average particle size (μm) | Number % less than or equal to 5 μm | Resolution |
|---|---|---|---|
| Example 1 | 8.51 | 65 | Very good (5.0) |
| Example 2 | 8.51 | 50 | Good (4.5) |
| Example 3 | 11.05 | 65 | Good (4.5) |
| Example 4 | 11.05 | 50 | Acceptable (4.0) |

The resolution estimates an extent to which intervals between lines in a copied image can be reported precisely with respect to previous images in which, (2. 0), (2. 2), (2. 5), (2. 8), (3.2), (3. 6), (4. 0), 4. 5), (5. 0), (5. 6) (6. 3), or (7. 1) number of vertical and horizontal lines respectively per mm, are lined up at a uniform interval.

Table 2 is a result of an experiment carried out to test the reproducibility of intervals between lines in a copied image with respect to line images lined up at the uniform interval with prescribed number of vertical and horizontal lines respectively per mm with respect to resolution.

A toner is composed of resin component and colorant. There are cases where wax component or inorganic fine grains are added to compose a toner. A method for manufacturing toner is not particularly restricted, and therefore either pulverization method or polymerization method can be employed.

All known resins can be used as a resin component. Some of such resins are: Styrene resins (monopolymers or copolymers including styrene or substituted styrene) like, styrene, poly-α-styryl styrene, styrene-chloro styrene copolymer, styrene-propylene copolymer, styrene-butadiene copolymer, styrene/vinyl-chloride copolymer, styrene-vinyl acetate copolymer, styrene-maleinic acid copolymer, styrene-acrylic ester copolymer, styrene-methacryl ester copolymer, styrene-α-methyl chloroacrylate copolymer, and styrene-acrylonitrile-acrylic ester copolymer, and other resins such as polyester resins, epoxy resins, vinyl chloride resins, rosin modified maleinic acid resins, phenolic resins, polyethylene resins, polyester resins, polypropylene resins, petroleum resins, polyurethane resins, ketonic resins, ethylene-ethyl acrylate copolymer, xylene resins, and polyvinyl butyrate resins can be used. These can be used independently or more than one together.

Colorants to be used are not particularly restricted and known colorants like carbon black, lamp black, iron black, ultramarine, nigrosine dye, aniline blue, chalco oil blue, oil black, azo oil black are used.

Wax components to be used are not particularly restricted and known wax components like carnauba wax, rice wax, synthetic ester wax are used.

Fine powder of silica or titanium oxide, etc., which are known, are used as inorganic fine grains.

The transfer unit 6 used in the image forming apparatus 1 of FIG. 1, is structured by assembling a transfer charger 6A and a separating charger 6B that is adjacent to the charger 6A and separates a recording sheet from the photoreceptor drum 2.

The cleaning unit 7 is equipped with a decharging roller 7A and a cleaning blade 7B. An excess toner on the photoreceptor drum 2 that is scraped by the cleaning blade 7B is sent towards the developing unit 5 by a transferring screw 7C positioned in a toner recovery section, and recycled. A quenching lamp 7D for making residual electric potential on the photoreceptor drum zero is provided in the cleaning unit 7, thereby eliminating the electric potential history that affects charging carried out by the charging unit 3. An electric potential sensor (not shown) detects a surface electric potential on the photoreceptor drum 2 prior to transferring the toner. Reference numeral 9 in FIG. 1 denotes a decharging lamp decharging prior to transfer of toner that is used for eliminating electric potential on the surface of the photoreceptor drum. Reference numeral 10 in FIG. 1 denotes a charger charging prior to transfer of toner that improves the transfer efficiency by making the charging amount of toner uniform prior to the transferring. Reference numeral 11 denotes an electric potential sensor for monitoring the surface electric potential of the photoreceptor drum 2, reference numeral 12 denotes a registration roller pair, and reference numeral 13 denotes a paper feeding guide.

The charging unit 3 is used for charging of the photoreceptor drum 2 after the cleaning is carried out by the cleaning unit, and has a structure such that the charging unit 3 is not in contact with the photoreceptor drum 2.

The charging unit 3 uses a charger wire 3A as the charging wire, which is a thin metal wire of tungsten etc. This wire has a structure such that the wire is extended in a main scanning direction of the photoreceptor drum 2 and enables charging by a corotoron method.

The charger wire 3A is a tungsten wire having a diameter between 30 μm and 120 μm, and the surface of the tungsten wire is subjected to gold or platinum plating or sputtering. In the present embodiment, the thickness of gold or platinum that is subjected to plating or sputtering on the wire is between 0.1 μm and 1.5 μm.

Since the present embodiment is structured as mentioned above, the results of tests on abrasion resistance, occurrence of charging unevenness, and arc discharge resistance are shown below.

Table 3 represents the results of the tests indicating a relationship of the thickness of a gold or platinum layer formed by plating or sputtering on the tungsten surface of the charger wire 3A with the abrasion resistance, the occurrence of charging unevenness, and the arc discharge resistance of the wire.

TABLE 3

| | Layer thickness | Abrasion resistance (*1) | Arc discharge resistance & Charging uniformity (*2) | Cost |
|---|---|---|---|---|
| Example 1 | 0.08 μm | Insufficient | Observed | Feasible |
| Example 2 | 0.6 μm | Sufficient | Observed | Feasible |
| Example 3 | 1.8 μm | Sufficient | Observed | Not feasible |

*1: Results of abrasion resistance observed when a felt wire cleaner is operated for every ten thousand imaging operations and three hundred thousand images are formed. For the wire having the layer thickness of 0.08 μm in example 1, the abrasion of gold or platinum on the surface was observed and an exposed tungsten surface of the wire was also observed.

*2: Results of occurrence of arc discharge observed when three hundred thousand images were formed. Results of observation as to whether density unevenness of a copied image with overall uniformity in half tone occurs in a secondary scanning direction (paper transfer direction).

According to table 3, it can be seen that an image having no charging unevenness, favorable abrasion resistance and arc discharge resistance can be obtained when the layer thickness of gold or platinum plating or sputtering was in the range of 0.1 μm to 1.5 μm. It can be also seen that these results are favorable in the range mentioned above in order to achieve such type of function, particularly from the cost point of view.

Table 4 represents the results of tests indicating a relationship between a diameter of the charger wire 3A made of tungsten and a mechanical strength of this charger wire 3A when it is in stretched condition in the charging unit 3, i.e., a relationship of the diameter of the wire with a tensile breaking strength, occurrence of charging unevenness, and arc discharge resistance of the wire.

TABLE 4

| | Wire diameter | Mechanical strength (*1) | Arc discharge resistance & charging uniformity (*2) |
|---|---|---|---|
| Example 1 | 25 μm | Insufficient | Observed |
| Example 2 | 60 μm | Sufficient | Observed |
| Example 3 | 130 μm | Sufficient | Not observed |

*1: Results of observation of a wire break when tension of 3N was applied intermittently for 1000 times, assuming the tension in wire (between 1.5N and 3N) when the wire is stretched in the charging unit.
*2: Results of occurrence of arc discharge observed when three hundred thousand images were formed. Results of observation as to whether density unevenness of a copied image with overall uniformity in half tone occurs in a secondary scanning direction (paper transfer direction).

According to table 4, it can be seen that by choosing a range between 30 μm and 120 μm as a diameter of the wire, the tensile breaking strength of the wire can be secured and an image having favorable abrasion resistance and arc discharge resistance with no charging unevenness can be achieved.

It is assumed that the toner of a particle size between 5 μm and 10 μm with 60 to 80 number percentage particles having a particle size less than or equal to 5 μm is used for achieving a highly defined image with high resolution in the charging unit 3 in which the charging wire 3A is used. Based on this, even if the toner remains on the latent image carrier, it is possible to prevent the formation of a faulty image by preventing the deterioration of the charging function like occurrence of the charging unevenness caused by sticking of the toner.

Besides this, since the charging wire used in the charging unit is plated or sputtered with gold or platinum, the smoothness of the wire is improved and occurrence of micro cracks or scratches during processing can be minimized. This hinders the sticking of any toner or dust floating in the surrounding area, thereby enabling to prevent the deterioration of charging function by controlling the charging unevenness or arc discharge. Therefore, it is possible to prevent the formation of a faulty image due to deterioration of the charging function during the elapsed time.

Further, since the thickness of the layer of gold or platinum, plated or sputtered on the wire used for charging, is between 0.1 μm and 1.5 μm, it enables to improve the wear and abrasion resistance of the wire and to prevent coming off of the plated or sputtered layer of gold or platinum. This assures the prevention of the occurrence of charging unevenness and arc discharge during the elapsed time. Furthermore, since the diameter of the wire for charging which is plated or sputtered with gold or platinum, is between 30 μm and 120 μm, there is no rise in discharge voltage, and therefore charging unevenness and arc discharge can be prevented while maintaining the assured mechanical strength. This assures the prevention of formation of a faulty image.

The cleaning unit 14 used for cleaning the charger wire 3A as a wire for charging used in the charging unit 3 will be explained below.

Figure 2A:
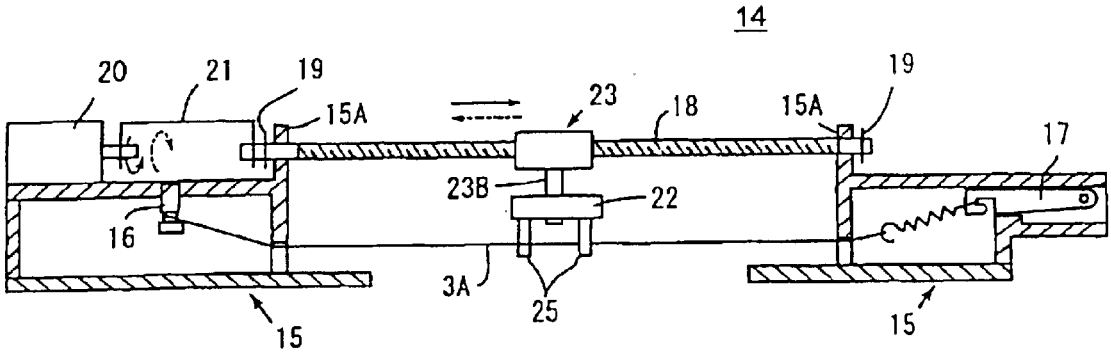
FIG. 2A is a sectional view of a charger wire as a wire for charging in a direction of its extension.
Figure 2B:
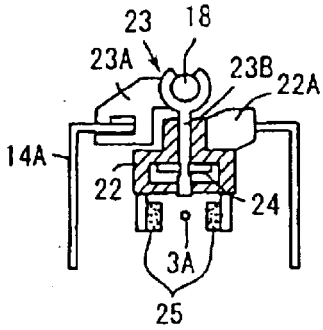
FIG. 2B is a sectional view of a cleaning pad support for the charger wire.

FIGS. 2A and 2B illustrate the structure of the wire cleaning unit 14. FIG. 2A is a sectional view of the charger wire 3A in the direction of extension and FIG. 2B is a sectional view of a cleaning pad support which is explained below.

In FIG. 2A, the wire cleaning unit 14 is provided with end blocks 15, which are positioned at two ends of the stretched charger wire 3A in order to support the stretching of the charger wire 3A.

The end blocks 15 are provided with electrodes 16 and 17 and a driving screw 18. More specifically, the electrodes 16 and 17 are positioned in the directions of stretching of the charger wire 3A and are tied up with the charger wire at two ends, and the driving screw 18 is positioned above the charger wire 3A.

Two axial ends of the driving screw 18 are inserted into and passed through two vertical bars 15A which are perpendicular to the end blocks 15 so as to be rotatably supported. Further, movement of the driving screw 18 in the axial direction is restricted by locking rings 19.

One end of the driving screw 18 in the axial direction is coupled with one end of a transmission member 21. The transmission member 21 made of an elastic material, transmits torque of a drive motor 20 which is mounted on the end block 15, to the driving screw 18.

The transmission member 21 is in the form of a channel when viewed from a side in FIG. 2A. The driving screw 18 can be rotated in the same direction as the direction of rotation of the drive motor 20.

A female screw 23 is engaged with the driving screw 18. This female screw 23 supports a cleaning pad support 22 in a suspended manner.

As shown in the FIG. 2B, a sliding section 23A is formed on the female screw 23. This sliding section 23A can fit in and slide along the edge section (for the sake of convenience, hereinafter aperture edge) formed on an aperture 14B (refer to FIGS. 4A and 4B), which is formed in a shielding case 14A of the charging unit 14. Thus, the sliding section 23A can move only in the axial direction of the driving screw 18 due to the use of the aperture edge as a stopper.

A rod 23B that is suspended downward is integrated with a bottom side of the female screw 23, and inserted through and fitted in the cleaning pad support 22.

The cleaning pad support 22 is engaged and fitted with the rod 23B of the female screw 23 and prevented from coming out by a locking ring 24. Thus, the cleaning pad support 22 is supported by the female screw 23 in a suspended manner such that it can swing in a horizontal plane.

Figure 4A:
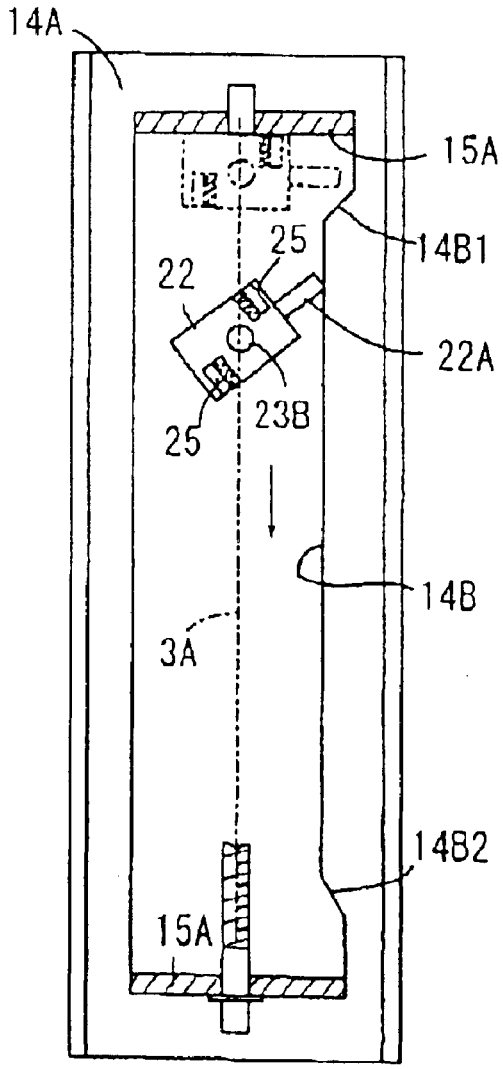
FIG. 4A illustrates one mode of the cleaning pad support.
Figure 4B:
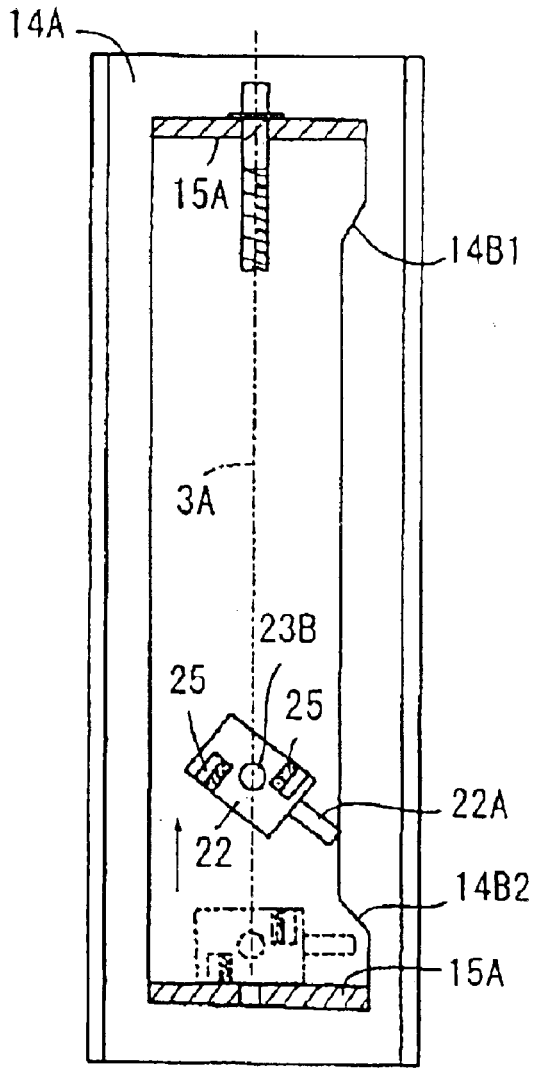
FIG. 4B illustrates another mode of the cleaning pad support.

In FIG. 2B, the cleaning pad support 22 is formed with the sliding section 23A provided on the female screw 23 and an engaging piece 22A provided opposite to the sliding section 23A and projected toward the outer side. This engaging piece 22A is structured so as to be engaged with a guide section 14B that is formed in the shielding case 14A as illustrated in FIGS. 4A and 4B.

Figure 3A:
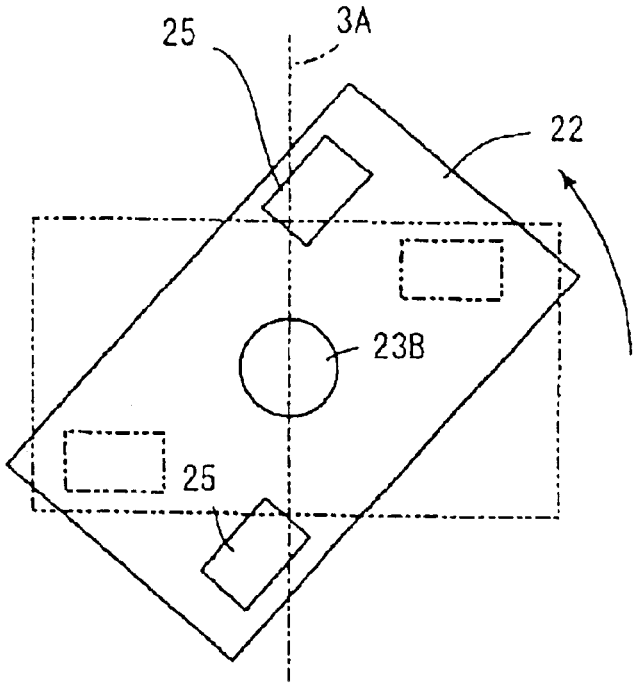
FIG. 3A is an example of the cleaning pad support in an initial state and after being swung from the initial state.
Figure 3B:
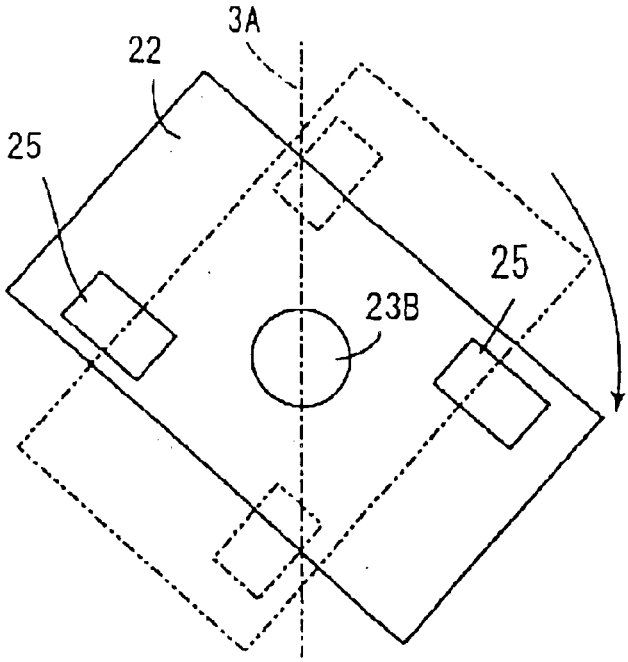
FIG. 3B is a state of the cleaning pad support after being swung in other direction from the position in FIG. 3A.

The bottom surface of the cleaning pad support 22 is provided with a pair of cleaning pads. 25 with the positional relationship set as illustrated in FIGS. 3A and 3B.

In the present embodiment, the cleaning pads 25 in FIGS. 3A and 3B have following characteristics. A nonwoven fabric made of an elastic material is used for the cleaning pads 25. The elastic material is like felt that does not contain any abrasive material like silica powder, ceramic powder, or alumina powder of respective particles with a particle size between 10 μm and 40 μm. The cleaning pads 25 provided on the bottom surface of the cleaning pad support 22, are arranged on one of diagonal lines of the bottom and on opposite ends of the diagonal line.

According to the positional relation between the cleaning pads 25 at the bottom surface of the cleaning pad support 22, the following states of the cleaning pads 25 can be selected depending on a direction to which the cleaning pads 25 are swung around the rod 23B of the female screw 23 as the fulcrum. That is, one of the states is such that the cleaning pads 25 are in contact with the charger wire 3A as shown in FIG. 3A, and the other state is such that the cleaning pads 25 are apart from the charger wire 3A as shown in FIG. 3B.

As illustrated in FIGS. 4A and 4B, recess parts 14B1 and 14B2 are formed on the aperture 14B of the shielding case 14A provided to set a swing direction of the cleaning pad support 22. These recess parts are provided to allow the cleaning pad support 22 to be displaced through swinging with the engaging piece 22A of the cleaning pad support 22 abutting against the recess parts 14B1 and 14B2.

The direction of movement of the cleaning pad support 22 from a position where it is in contact with the end block 15 is set according to the direction of rotation of the driving screw 18. When the cleaning pad support 22 is moving in the downward direction from the position in contact with the end block 15 as shown in FIG. 4A, the engaging piece 22A abuts against the recess part 14B1, and therefore the cleaning pad support 22 swings in the counterclockwise direction. When the cleaning pad support 22 is moving in the upward direction, the engaging piece 22A abuts against the recess part 14B2, and therefore the cleaning pad support 22 swings in the clockwise direction. In the present embodiment, as is explained with FIGS. 3A and 3B, the cleaning pads 25 come in contact with the charger wire 3A and carry out cleaning of the wire in the swing direction of the cleaning pad support 22 in FIG. 4A. Whereas, the cleaning pads 25 separate from the charger wire 3A in the swing direction of the cleaning pad support 22 in FIG. 4B.

In the present embodiment, the wire cleaning unit 14 starts operating at a preset time, like at the completion of the image formation process etc.

The drive motor 20 is a DC motor that can rotate in both normal and reverse directions and one rotation cycle in which the cleaning pad support 22 is made to complete one reciprocating action, is set.

The cleaning pad support 22 can be shifted in a direction in which the charger wire 3A is extended, through rotations of the driving screw 18 driven by the drive motor 20. The cleaning pad support 22 can be stopped and held in a standby state at the position where it is in contact with the end block 15 by regulating the rotating time (number of rotations) of the drive motor 20 in advance. The rotating time of the drive motor 20 is set to a minimum value that is required to shift the cleaning pad support 22 between the end blocks 15. This is for preventing the over tightening of the screw when the cleaning pad support is in contact with the end block 15. In this embodiment, a DC motor is used as the drive motor 20 and the driving screw 18 is driven by setting the speed reduction ratio. Therefore, the energy up to an output shaft of the drive motor 20 accounts for the energy of inertia of rotation in the drive system. The kinetic energy in the drive system when the cleaning pad support 22 comes in contact with the end block 15, is either discharged or stored in other section, thereby preventing the over tightening of the female screw 23. Furthermore, a pulse motor can be used as the drive motor 20. In such a case, a number of pulses is set in advance to a value, which is sufficient to give a ½ reciprocating motion of the cleaning pad support 22 that is in the standby state. By carrying out this setting in advance, it is possible to stop the cleaning pad support in a prescribed position and prevent the over tightening of the female screw 23.

The wire cleaning unit 14 in FIGS. 4A and 4B brings the cleaning pad support 22 in contact with the end block 15 and holds it there in the standby state till the cleaning of the charger wire 3A is started.

When the charger wire 3A is cleaned, the male nut (driving screw) 18 is rotated by the drive motor 20 and shifts the charger wire 3A in the direction of extension through the female screw 23.

When the cleaning pad support 22 is shifted, the engaging piece 22A abuts against the recess parts 14B1 and 14B2 in the aperture 14B of the shielding case 14. Depending on the swing direction after abutting, the two following cases are set during one reciprocating motion. More specifically, one of the cases is such that the cleaning pad 25 shifts while the cleaning pad 25 coming in contact with the charger wire 3A is cleaning the wire 3A, and the other case is such that the cleaning pad 25 shifts while being away from the charger wire 3A as illustrated in FIGS. 4A and 4B.

In the present embodiment, the cleaning pad 25 does not contain any abrasive material. Therefore, when the cleaning pad 25 scrapes the charger wire 3A while being in contact with it in order to remove the particles stuck on it, it does not chip the surface of the charger wire 3A. Hence, there are no minute scratches in units of micron on the surface of the charger wire 3A, and therefore no dust or toner floating around these scratches as core, get stuck on the charger wire 3A.

The inventor of the present invention carried out experiments to see an effect on an image by the cleaning pad 25 which did not contain any abrasive material, and the cleaning pad 25 which contained an abrasive material. The results of these experiments are shown in table 5 below.

TABLE 5

| | | | Imaging of 100,000 images | Imaging of 300,000 images |
|---|---|---|---|---|
| Example 1 | Gold plated tungsten | Elastic material without abrasive | Good (not occurred) | Good |
| Example 2 | Gold plated tungsten | Elastic material with abrasive | Not good (occurred) | Not good |
| Example 3 | Electro polished tungsten | Elastic material without abrasive | Good | Not good |
| Example 4 | Electro polished tungsten | Elastic material with abrasive | Not good | Not good |

Charging unevenness is observed through occurrence of density unevenness on copied images with overall uniformity in half tone of the charging, in a secondary scanning direction (paper transfer direction).

According to table 5, it can be seen that when abrasive material is not used, the occurrence of charging unevenness, which affects the density unevenness of an image, is less.

According to the present embodiment, while removing foreign particles stuck on the charger wire 3A, the charger wire 3A and the cleaning pad 25 are brought in contact only during the approaching movement of the cleaning pad support 22. The cleaning pad 25 can be separated from the charger wire 3A during the returning movement of the cleaning pad support 22. Therefore, the foreign particles removed by wiping from the surface of the charger wire 3A are prevented from sticking again to the charger wire 3A.

Further, the charger wire is not limited to the corotoron type. A scorotoron type in which the charging electric potential is controlled by controlling the voltage by printing on a grid that is provided between the wire and photoreceptor drum 2 can also be used.

According to one aspect of the present invention, the latent image carrier is charged without being in contact with the charger. When toner of particle size between 5 μm and 10 μm with 60 to 80 number percentage particles having a particle size less than or equal to 5 μm which gives a highly defined image with high resolution is used, even if the toner remains on the latent image carrier, it is possible to prevent the deterioration of charging function such as occurrence of charging unevenness or the like caused due to sticking of toner. Thus, it is possible to prevent occurrence of defective images.

Moreover, the surface of the charger wire used in the charging unit, is plated or sputtered by gold or platinum. This improves the smoothness of the wire and restrains occurrence of micro cracks or scratches during processing. Due to this, the dust and toner in the surrounding area cannot stick easily. Thus, it is possible to prevent the deterioration of the charging function by minimizing occurrence of the arc discharge and charging unevenness during elapsed time. This leads to prevention of defective images caused due to deterioration of the charging function.

Furthermore, the thickness of the gold or platinum layer plated or sputtered on the wire for charging is between 0.1 μm and 1.5 μm. When the thickness is in this range, it improves the wear and abrasion resistance and prevents coming off of this layer during elapsed time, thereby assuring prevention of arc discharge and charging unevenness during elapsed time.

Moreover, the diameter of the charger wire plated or sputtered with gold or platinum, is set between 30 μm and 120 μm. When the diameter is in this range, there is no rise in discharge voltage, and mechanical strength is also achieved. Thus, it is possible to prevent charging unevenness and arc discharge, thereby ensuring prevention of any defective image formation.

Furthermore, the elastic material that does not include any abrasive material is used as the cleaning pad for cleaning the charging wire which is plated or sputtered by gold or platinum. Due to the absence of any abrasive material, it is possible to suppress the occurrence of any scratches in the units of micron while the charging wire is being scraped. This helps in maintaining the smoothness of the surface of the charging wire and removing the particles stuck on the wire. Thus, it is possible to prevent the deterioration of the charging function due to the arc discharge or charging unevenness caused by sticking of foreign particles.

The present document incorporates by reference the entire contents of Japanese priority documents, 2002-122306 filed in Japan on Apr. 24, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus that performs visible image processing on an electrostatic latent image that is formed on an electrostatic latent image carrier, by using a developer that includes a toner with a volume average particle size between 5 μm and 10 μm and 60 to 80 number percentage particles having a particle size less than or equal to 5 μm, the image forming apparatus comprising:

a charging unit configured to uniformly charge the electrostatic latent image carrier, the charging unit including a wire provided with only a single gold layer with a thickness between 0.1 μm and 1.5 μm or only a single platinum layer with a thickness between 0.1 μm and 1.5 μm; and a cleaning unit configured to clean a surface of the charging unit, the cleaning unit including:

a cleaning pad holder configured to pivot about a first axis and configured to move along a conveyance structure in a direction perpendicular to the first axis, and a first cleaning pad held by the cleaning pad holder, wherein the charging unit and the electrostatic latent image carrier are not in contact with each other.

2. The image forming apparatus according to claim 1, wherein the layer is formed by plating.

3. The image forming apparatus according to claim 2, wherein the thickness is 0.6 μm.

4. The image forming apparatus according to claim 2, wherein a diameter of the wire is between 30 μm and 120 μm.

5. The image forming apparatus according to claim 1, wherein the layer is formed by sputtering.

6. The image forming apparatus according to claim 5, wherein the thickness is 0.6 μm.

7. The image forming apparatus according to claim 5, wherein a diameter of the wire is between 30 μm and 120 μm.

8. The image forming apparatus according to claim 1, wherein the first cleaning pad of the cleaning unit comes in contact with the charging unit, wherein the first cleaning pad is made of an elastic material which does not contain any abrasive.

9. The image forming apparatus according to claim 1, the cleaning unit further including a second cleaning pad, wherein the first cleaning pad and the second cleaning pad are provided horizontally with respect to the wire.

10. A charging device configured to uniformly charge an electrostatic latent image carrier to thereby perform visible image processing, on an electrostatic latent image formed on the electrostatic latent image carrier, by using a developer that includes a toner with a volume average particle size between 5 μm and 10 μm and 60 to 80 number percentage particles having a particle size less than or equal to 5 μm, the charging device comprising:

a wire provided with only a single gold layer with a thickness between 0.1 μm and 1.5 μm or only a single platinum layer with a thickness between 0.1 μm and 1.5 μm, wherein the charging device and the electrostatic latent image carrier are not in contact with each other, and the charging device further includes a cleaning unit configured to clean a surface of the charging device, the cleaning unit comprising:

a cleaning pad holder configured to pivot about a first axis and configured to move along a conveyance structure in a direction perpendicular to the first axis; and a first cleaning pad held by the cleaning pad holder.

11. The charging device according to claim 10, wherein the layer is formed by plating.

12. The image forming apparatus according to claim 11, wherein the thickness is 0.6 μm.

13. The charging device according to claim 11, wherein a diameter of the wire is between 30 μm and 120 μm.

14. The charging device according to claim 10, wherein the layer is formed by sputtering.

15. The image forming apparatus according to claim 14, wherein the thickness is 0.6 μm.

16. The charging device according to claim 14, wherein a diameter of the wire is between 30 μm and 120 μm.

17. The charging device according to claim 10, the cleaning unit further including a second cleaning pad, wherein the first cleaning pad and the second cleaning pad are provided horizontally with respect to the wire.

18. An image forming apparatus comprising:

toner including toner particles, the toner particles having a volume average particle size between 5 μm and 10 μm, and 60 to 80 percent of the toner particles having a particle size less than or equal to 5 μm;

a charging unit including a wire provided with only a single gold layer with a thickness of between 0.1 μm and 1.5 μm or only a single platinum layer with a thickness between 0.1 μm and 1.5 μm; and a cleaning unit configured to clean a surface of the charging unit, the cleaning unit including:

a cleaning pad holder configured to pivot about a first axis and configured to move along a conveyance structure in a direction perpendicular to the first axis, and a first cleaning pad held by the cleaning pad holder.

19. The image forming apparatus according to claim 18, wherein the layer is formed by plating.

20. The image forming apparatus according to claim 18, wherein the layer is formed by sputtering.

21. The image forming apparatus according to claim 18, wherein the thickness is 0.6 μm.

22. The image forming apparatus according to claim 18, wherein a diameter of the wire is between 30 μm and 120 μm.

23. The image forming apparatus according to claim 18, the cleaning unit further including a second cleaning pad, wherein the first cleaning pad and the second cleaning pad are provided horizontally with respect to the wire.

* * * * *